US011208823B2

(12) United States Patent
Hwang et al.

(10) Patent No.: US 11,208,823 B2
(45) Date of Patent: Dec. 28, 2021

(54) APPARATUS FOR LEFT AND RIGHT ALIGNMENT OF VEHICLES IN PARKING INSTALLATION

(71) Applicants: KONE ENGINEERING IND.CO., LTD, Gimpo-si (KR); Chang Guk Hwang, Incheon (KR)

(72) Inventors: Chang Guk Hwang, Incheon (KR); Ki Bog Hwang, Incheon (KR)

(73) Assignees: KONE ENGINEERING IND.CO., LTD, Gimpo-si (KR); Chang Guk Hwang, Incheon (KR)

( * ) Notice: Subject to any disclaimer, the term of this patent is extended or adjusted under 35 U.S.C. 154(b) by 0 days.

(21) Appl. No.: 16/334,116

(22) PCT Filed: Oct. 30, 2018

(86) PCT No.: PCT/KR2018/013005
§ 371 (c)(1),
(2) Date: Nov. 10, 2020

(87) PCT Pub. No.: WO2019/172499
PCT Pub. Date: Sep. 12, 2019

(65) Prior Publication Data

US 2021/0054642 A1 Feb. 25, 2021

(30) Foreign Application Priority Data

Mar. 5, 2018 (KR) ..... 10-2018-0025821

(51) Int. Cl.
*E04H 6/42* (2006.01)
*E04H 6/30* (2006.01)

(52) U.S. Cl.
CPC ..... *E04H 6/424* (2013.01); *E04H 6/305* (2013.01)

(58) Field of Classification Search
CPC . E04H 6/28; E04H 6/305; E04H 6/424; B60S 13/02
See application file for complete search history.

(56) References Cited

U.S. PATENT DOCUMENTS 5,012,745 A * 5/1991 Yamashita ..... B60S 13/02 104/44
5,148,752 A * 9/1992 Yamashita ..... B60S 13/02 104/44

(Continued)

FOREIGN PATENT DOCUMENTS

EP 2584119 * 10/2011 ..... E04H 6/18
KR 1994-0000712 A 1/1994

(Continued)

*Primary Examiner* — Mark C Hageman
(74) *Attorney, Agent, or Firm* — Novick, Kim & Lee, PLLC; Jae Youn Kim

(57) ABSTRACT

The present invention relates to a vehicle left and right alignment device for a parking facility. Provided is a vehicle left and right alignment device for a parking facility which is installed at an entrance of a parking facility to align wheels of an incoming vehicle, the device comprising: a front wheel alignment unit (2, 2') and a rear wheel alignment unit (3) respectively provided on both sides of a central passage part (11) of a frame (1) installed at the entrance of the parking facility. The rear wheel alignment unit (3) comprises: a plurality of rollers (31) extending in the longitudinal direction of the vehicle body and arranged in the vehicle width direction to be rotatable; and a driving unit (30) for rotating the rollers (31) to adjust and align the position of a rear wheel of the vehicle positioned on the rollers (31). The present invention solves conventional problems in which durability is decreased due to occurrence of uneven wear caused by uneven loads applied to a moving means or the body of a vehicle is damaged as a vehicle is moved by a moving means in a non-aligned state. As such, (Continued)

the present invention has an effect of safely performing vehicle transfer by means of a moving means and an effect of reducing manufacturing costs by simplifying a structure.

8 Claims, 7 Drawing Sheets

(56) References Cited

U.S. PATENT DOCUMENTS

| | | | | |
|---|---|---|---|---|
| 10,975,588 | B2 * | 4/2021 | Lin | E04H 6/285 |
| 2010/0034626 | A1 * | 2/2010 | Reiniger | E04H 6/183<br>414/253 |

FOREIGN PATENT DOCUMENTS

| | | | |
|---|---|---|---|
| KR | 1999-010092 | U | 3/2000 |
| KR | 2003-0057583 | A | 7/2003 |
| KR | 10-1393610 | B1 | 5/2014 |

* cited by examiner

APPARATUS FOR LEFT AND RIGHT ALIGNMENT OF VEHICLES IN PARKING INSTALLATION

TECHNICAL FIELD

This invention relates to an improved vehicle left-right alignment apparatus in parking facility, adapted to lift the vehicles more safely by arms mounted on a conveyance truck at the entrance of parking facility, in which a vehicle coming through path of parking facility is conveyed to the parking area in a lifted-up status by arms mounted on a conveyance truck.

BACKGROUND ART

Lately, as the car users are increased and the land for the parking lot is insufficient to the contrary, the construction of parking buildings have been consistently increased for the efficient use of land and the introduction of automatic parking facilities using parking robots are also increased in the parking-dedicated buildings as well as in the existing building too.

As an example of such a parking robot, Korean Patent Laid-Open Publication No. 1994-0000712 (published Jan. 18, 1994) discloses a vehicle conveying device of a multi-level parking facility, in which a vehicle is lifted by a swing arm attached in an auxiliary carrier and conveyed.

As an another example, the Korean Registered Patent No. 10-1393610 (registered May 2, 2014) discloses a transfer device, in which an vehicle transport apparatus in a parking system, equipped with a pair of pallets, to move a vehicle while lifting the wheels by the rotatable arms mounted on both sides of the main frame.

When such a vehicle conveying device moves to the center of the passage, the arms are rotated at right angle to the wheels of the vehicle in a horizontal storage position on the main frame, then the vehicle is conveyed to the parking location by the conveyance device while lifting the wheels.

However, if the vehicle entering the parking facility is not properly aligned, the arms may not be arranged at right angle to the wheels on both sides of the vehicle, thereby can damage the wheels, or the body of the vehicle as the arm contacted the body. As a result, an accident may occur unintentionally as the vehicle is not conveyed in a stable status.

In order to solve such a problem, Korean Patent Laid-Open Publication No. 2003-0057583 (published on Jul. 7, 2003) discloses a parking facility having a wheel alignment, and Korean Registered Utility Model No. 20-0184354 (Date Mar. 22, 2000) discloses the left-right alignment apparatus for a vehicle in a parking facility.

Such a conventional vehicle alignment apparatus is complicated in structure, and also, there is a problem that the vehicle entering the parking facility may be damaged in moving the vehicle for alignment.

Particularly, the vehicle alignment apparatus disclosed in Korean Utility Model Registration No. 20-0184354 (registered on Mar. 22, 2000), as the vehicle (T) enters between the left and right set to park, it becomes possible to flow left and right by idling rollers and, at this time, there is a problem that the vehicle or the wheels may be damaged in the structure in which the wheels of the vehicle are aligned in the center by the left and right guiders advancing proportionally in the left and right.

DISCLOSURE OF THE INVENTION

Object of the Invention

The purpose of the invention is to provide an improved vehicle left-right alignment apparatus in parking facility, in which to solve the technical problems of the conventional apparatus, an arrangement is made for the vehicle that entered the parking facility and conveyed to the parking area in a lifted-up status is to be loaded evenly on both sides by adjusting and making displacement the position of the front and the rear wheels alignment unit in the width direction in a preset range and, as a result, the vehicle is able to be parked properly.

According to the invention, there is provided a vehicle left-right alignment apparatus in parking facility installed at an entrance of a parking facility to align the wheels of the incoming vehicle, comprising:

a front wheel alignment unit and a rear wheel alignment unit provided on both sides of the passage part at the center of the frame installed in the entry part of the parking facility; the rear wheel alignment unit including a plurality of rollers extending in the longitudinal direction of the vehicle body and arranged to be rotatable in the vehicle width direction, and a drive for rotating the rollers so as to adjust and align the position of the rear wheel of the vehicle located above the rollers.

The driving unit includes a gear provided at one end of each of the plurality of rollers; a driving gear provided on an output shaft of the driving motor rotatable to in forward and reverse directions; a plurality of transmission gears to transmit the rotational force of the driving gear to the gear; and an above driving unit, the gears of the rollers and the transmission gears arranged to rotate the rollers together in the same direction.

Two of a plurality of transmission gears are directly engaged to the driving gear to rotate the roller gears, and each of the remaining transmission gears is arranged between the roller gears arranged in both side from the upper side of the driving gear to rotate adjacent gears.

The front wheel alignment unit may include a circular rotary plate that enables the positions of the front wheels on both sides of the vehicle outside the preset range are adjusted to be located within the set range; a driving motor to rotate the rotary plate in rotation and reverse rotation; and the rotary plates in the front wheel alignment units on both sides may be composed to rotate in the same direction at the same time.

And also, the rotating plate is rotatably supported by a support plate, and on the support plate, the rotation support device is provided at a plurality of places in a circle around the outer frame to support the bottom of the rotating plate.

The rotation support device may be composed of the balls arranged for freely rolling motion possible in a fixed case embedded in the support plate.

When the wheels of the vehicle are positioned on the rotating plate, there may be provided an intermediate support means disposed at a plurality of locations on the support plate in an annular shape radially inward of the rotation support device so as to prevent the intermediate part of the rotation plate from sagging due to the vehicle weight can contain more.

The intermediate support means may be composed of a slide member fixed to the rotation support plate with a pin so that the bottom surface of the rotation support plate is rotated while being slid against the support plate.

Alternatively, the above front wheel alignment part may be composed and arranged in the opposite direction with the same structure as the rear wheel alignment part in the configuration of including the rollers provided with the gears, the drive motors provided with drive gears, and the transmission gears.

Effects of the Invention

According to the invention, vehicle left-right alignment apparatus in parking facility includes the effects that the vehicle can be safely conveyed by the conveyance device and reduce the manufacturing cost by simplifying the structure, to act the load of the vehicle uniformly to the conveyance device, when moving the incoming vehicle by displacing the front wheels and the rear wheels on both sides of the vehicle entering the parking facility in the width direction of the frame, and by solving the problem of the vehicle body is damaged due to the vehicle being conveyed by the conventional conveying device in an unaligned state or low durability occurred by uneven wear due to uneven load.

DESCRIPTION OF THE EMBODIMENTS

Figure 1:
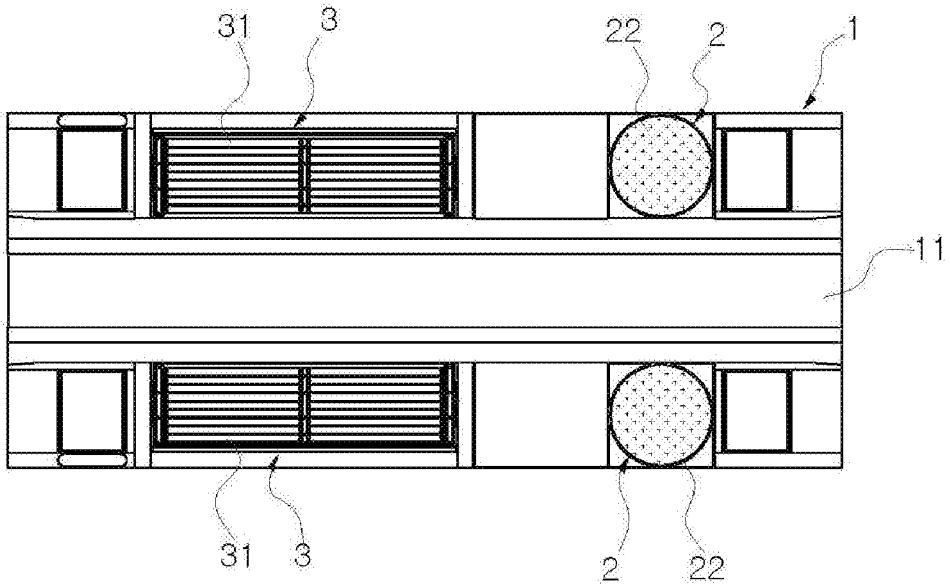
FIG. 1 is a schematic plan view of a vehicle left-right aligning apparatus for a parking facility according to the present invention.
Figure 2:
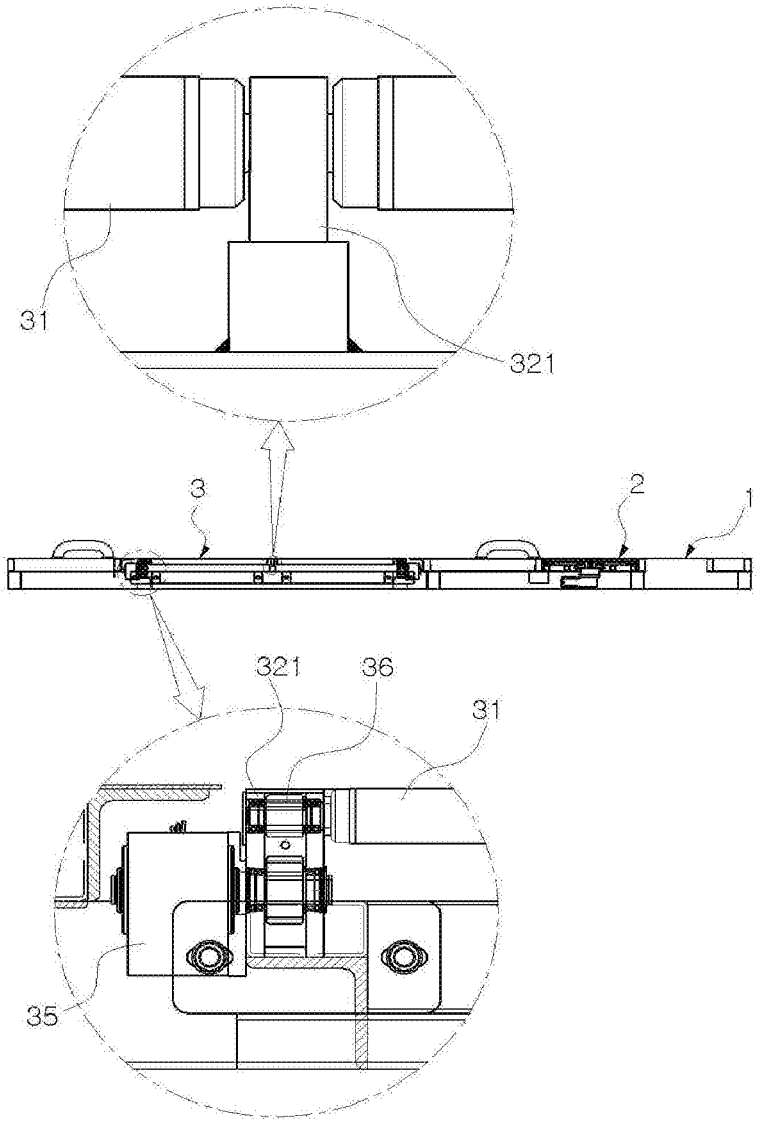
FIG. 2 is a schematic vertical cross-sectional view of the vehicle lateral alignment apparatus of FIG. 1.
Figure 3:
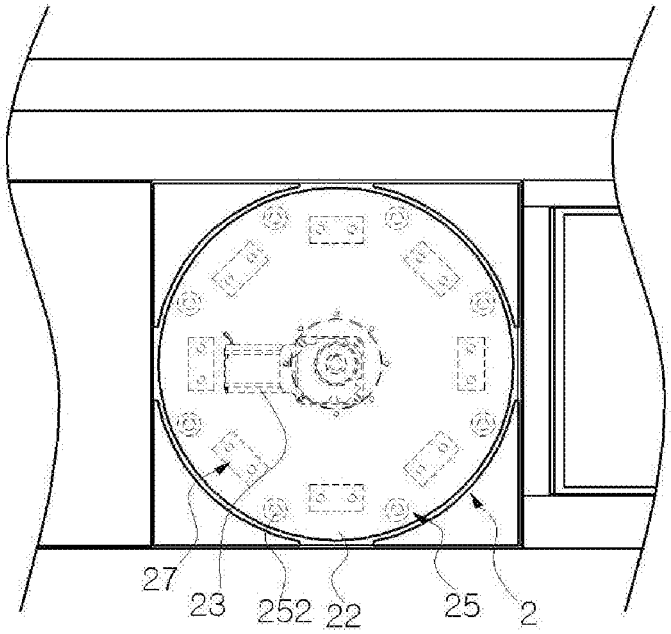
FIG. 3 is an enlarged schematic partial plan view of the front wheel alignment portion of FIG. 1.
Figure 4:
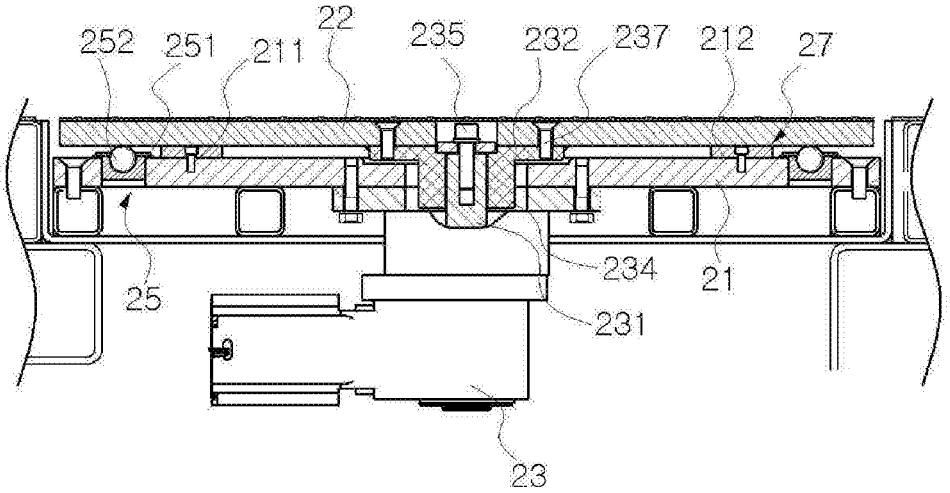
FIG. 4 is an enlarged longitudinal sectional view of FIG. 3.
Figure 5:
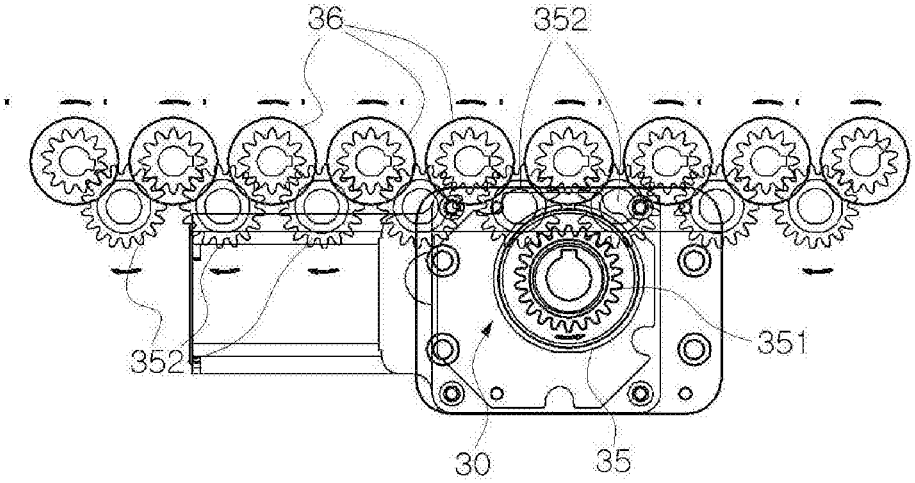
FIG. 5 is a schematic front view showing the driving mechanism of the driving unit for driving the rollers of the rear wheel alignment unit of FIG. 1.

Hereinafter, a vehicle left-right aligning apparatus of the invention will be more particularly described in consideration of the accompanying drawings which shows the embodiments.

Referring to FIGS. 1 to 5, according to this invention, a vehicle left-right aligning apparatus includes a frame 1 installed at an entrance of a parking facility, and a front wheel aligning unit 2 and a rear wheel aligning unit 3.

In the central part of the frame 1, for example, a passage path 11 for the conveying device to enter the lower side of the vehicle and lift the vehicle by a conveyance device to convey to the parking area is formed.

When the front wheel of the vehicle is deviated from the set range, the front wheel alignment unit 2 provided on both sides of the frame 1 shall be adjusted to the front wheel position on both sides of the vehicle to be positioned within the preset range.

For this purpose, the front wheel alignment unit 2 includes:

a support plate 21 mounted on the frame to support the front wheels;

a circular rotating plate 22 rotatably supported on the support plate 21;

a driving motor 23 for rotating the rotary plate 22 in forward and reverse directions; and a rotation support means 25 mounted on the support plate, wherein the rotation support means 25 provided in a circle, at a plurality of places around the outer border supports the bottom surface of the rotary plate 22.

And the rotation support means may be composed of the balls 252 arranged for freely rollable in a fixed case embedded in the support plate.

Besides, when the wheel is positioned on the rotary plate 22, in order to prevent the middle part of the rotary plate 22 from sagging due to the vehicle weight, intermediate supporting means 27 may be disposed in plural places inwardly to the radial direction at annular shape may be provided on the rotation support means 25.

The intermediate supporting means 27 comprises a slide member 212, fixed to the support plate 21 by a pin 211, the bottom surface of the rotating plate 22 is rotate against the support plate 21, while being slid on the slide member 212.

At the end of the output shaft 231 of the driving motor 23, a bushing type fixture 234, in which a flange 232 is formed, is fixed to a fastening hole 235 such as a bolt and the flange 232 is fixed to the rotary plate 22 by a fastener 237 such as a bolt. The driving motor may be composed by a step motor.

In the front wheel alignment units 22 on both sides, the rotary plates 22 are simultaneously rotated in the same direction and the position of the front wheel of the vehicle, which is disposed on the rotary plate 22 and deviated from a preset range, is changed to a preset range.

Generally, when the vehicle is stopped and turned off the engine, as the steering wheel is locked, and the rotary plate 22 in which the front wheels of the vehicle disposed rotates simultaneously, and the angle of the front side of the vehicle is changed to inside or outside on the frame, and at the same time, the rear wheel parts of the vehicle is also changed in the vehicle width direction as described later, the position of the vehicle is aligned within a preset range.

Such a change of the rear part of the vehicle body, in other words, change the position of the rear wheel is performed in the rear wheel alignment unit 3, and, to do this, the rear wheel alignment unit 3, provided on both sides of the frame 1, is extended in the longitudinal direction of the vehicle body, and include the plurality of rollers 31 arranged in the vehicle width direction and a driving unit for rotating the rollers 31.

The rollers 31 are supported rotatablely for both ends in the fixing parts 321 installed at preset distance in the width direction of the frame 1, and one end of each rollers are extended through the fixing portion 321 and gears 36 are mounted at the above extended, and the rollers 31 are rotated by rotating the gear 36 provided at one end of the rollers 31 through a plurality of transmission gears 352 which is engaged with the driving gear 351 provided on the output shaft of the forward and reverse rotatable driving motor 35, Two among the multiple transmission gears 352 rotate the gear 36 of the roller 31 which are directly engaged with the driving gear 351, and each of the remaining transmission gears 352 disposed between the gears 36 of the rollers 31 causes adjacent gears 36 to rotate, by doing this, the rollers 31 are rotated together in the same direction to displace the rear wheels together in the width direction of the vehicle.

Thus, when the driving gear 351 provided on the output shaft of the driving motor 35 rotates clockwise, two transmission gears 352 engaged with the driving gear 352 on both sides are rotated counterclockwise, and the gears 36 provided at one end of the roller 31 engaged with the transmission gears 352 rotate in the clockwise direction.

On the contrary, when the driving motor 35 rotates counterclockwise and the driving gear 351 of the output shaft rotates counterclockwise, the transmission gears 352 rotate in the clockwise direction, and the rollers 31 rotate together with the gears 36 in the counterclockwise direction.

The arrangement of the rollers 31 provided with the gear 36 of the rear wheel alignment unit 3, and the drive motor 35 provided with the driving gear 351 and the transmission gear 352 provided with the drive gear 351 are additionally in opposite as shown in FIG. 1, and this is because there may be differences in the distance between the front wheel and the rear wheel depending on the vehicle body length and type of vehicle.

The drive motor, the transmission gear and the rollers of the rear wheel alignment unit 3', which are additionally provided as described above, are disposed and operated in the reverse direction to the rear wheel alignment unit 3.

Thus, as the rollers 31 are rotated in the forward and reverse directions in accordance with the forward and reverse rotations of the driving motor 35, the rear wheel of the vehicle disposed thereon is moved in the vehicle width direction.

Figure 6:
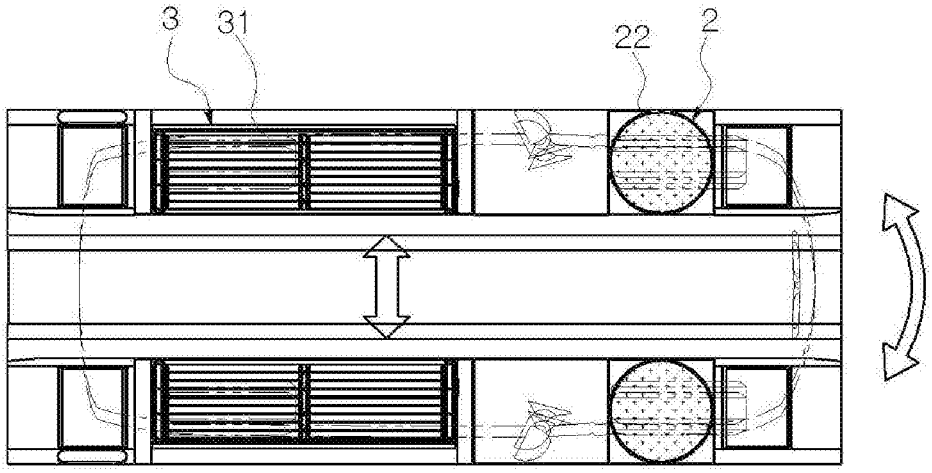
FIG. 6 is a schematic plan view showing a state in which the vehicle is aligned in the vehicle lateral alignment apparatus of FIG. 1.

Although not shown in the drawing, positioning sensors for sensing the position of the vehicle are provided to the front and rear wheels of the vehicle, and the driving motor 23 of the front wheel alignment unit 2 and the driving motor 35 of the rear wheel alignment unit 3 are independently controlled by a control unit not shown according to the signals from the position sensors, For instance, in FIG. 6, the vehicle misaligned upwards is in position (A), as the rotation plate 22 of the front wheel alignment unit 2 rotates clockwise and the rollers 31 of the rear wheel alignment unit 3 are also rotated in the clockwise direction samely, the vehicle moves to position (B) and aligned.

As a result, the vehicle is provided with front and rear wheels on both sides arranged evenly on both sides of the passage path 11 in a preset range so that the forwarding vehicle's load which has entered at the entrance path 11 is balanced on both side when the conveyance device lifts the vehicle.

Figure 7:
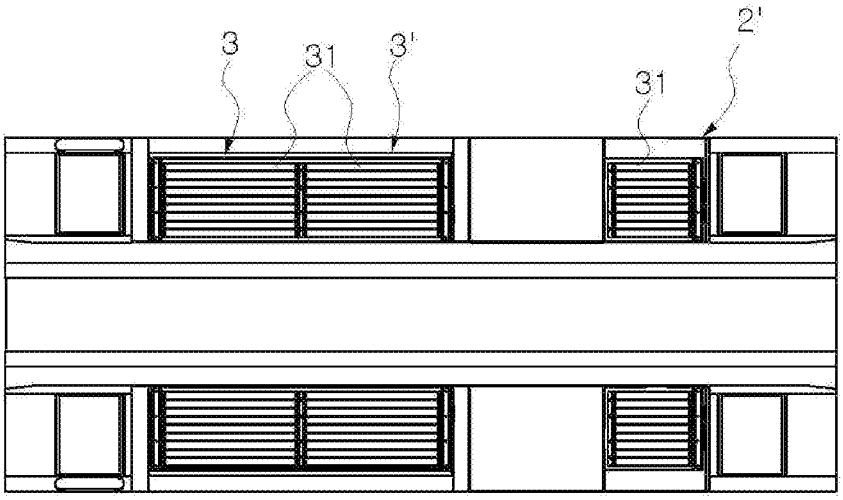
FIG. 7 is a schematic plan view of a vehicle left-right aligning apparatus provided with the front wheel aligning portion of the modification in FIG. 1.

In FIG. 7, a modified embodiment of the front wheel alignment unit 2 is shown. In the modified embodiment, instead of changing the position of the front wheel by rotating the circular rotary plate 22 rotatably supported on the support plate 21 by the drive motor 23, the front wheel alignment unit 2' can be arranged as the same structure as the rear wheel alignment unit 3' that includes the rollers 31 provided with the gear 36, the driving motor 35 provided with the driving gear 351 and transmission gears 352 in the same arrangement with the rear wheel alignment unit 3.

Accordingly, as the front and rear wheels are driven by rollers rotated in the vehicle width direction to a vehicle which has entered the wrong position at the entrance of the parking facility conveying the vehicle to the correct position in the vehicle width direction by the rollers, can move the vehicle safely to the correct parking position when the vehicle is lifted by the conveyance device which enters the passage path 11 formed at the center portion of the frame 1.

INDUSTRIAL APPLICABILITY

This invention can be used to align the front and rear wheels of a vehicle transported by the conveying device.

What is claimed is:

1. A left-right alignment apparatus for a vehicle, comprising:

a frame;

a passage section disposed at a center of the frame;

a front wheel alignment unit;

and a rear wheel alignment unit provided on two sides of the passage section, wherein the front wheel alignment unit includes a left and a right rotary configured to reposition front wheels of the vehicle within a preset range when the front wheels are placed on the left and right rotary plates outside the preset range, and a drive motor for rotating the left and right rotary plates in forward or reverse direction, wherein the left and right rotary plates rotate in the same direction simultaneously while rotating in the forward or reverse direction, and wherein the rear wheel alignment unit includes a plurality of rollers arranged extendable in a longitudinal direction of the vehicle and rotatable in a width direction of the vehicle, and a driving unit for rotating the rollers to align positions of rear wheels of the vehicle mounted disposed on the rollers.

2. The left-right alignment apparatus according to claim 1, wherein the driving unit includes gears provided at one end of each of the plurality of rollers and driving gears provided on an output shaft of a forwardly and reversely rotatable drive motor, a plurality of transmission gears for transmitting rotational force of the driving gears to the gear, and the driving gears, the gears and the transmission gears being arranged to rotate the rollers together in a same direction.

3. The left-right alignment apparatus according to claim 2, wherein two of the plurality of transmission gears are directly engaged with the driving gears and rotate the gears of the rollers, and each of the remaining transmission gears are disposed between the gears of the rollers.

4. The left-right alignment apparatus according to claim 2, wherein the front wheel alignment unit is arranged in an opposite direction with the same structure as that of the rear wheel alignment unit.

5. The left-right alignment apparatus according to claim 1, wherein the respective rotary plate is rotatably supported by a supporting plate mounted on the frame, and the rotary supporting means to support a bottom surface of the respective rotary plate on the support plate is disposed around an outer border of the support plate in a form of circle.

6. The left-right alignment apparatus according to claim 5, wherein the rotation support means includes balls arranged for freely rotatable in a fixed case embedded in the support plate.

7. The left-right alignment apparatus according to claim 5, further comprising a plurality of intermediate supporting means disposed in a plurality of places inwardly to a radial direction at an annular shape, than the rotation supporting means, to prevent a middle part of the respective rotary plate from sagging due to the vehicle weight on the support plate when the front wheels are positioned on the respective rotary plate.

8. The left-right alignment apparatus according to claim 7, wherein the intermediate support means comprises a slide member fixed to the rotary support plate by a pin so that a bottom plate of the intermediate support means can be rotated while sliding the bottom plate against the support plate.

* * * * *